US008638279B2

(12) United States Patent
Jeong

(10) Patent No.: US 8,638,279 B2
(45) Date of Patent: Jan. 28, 2014

(54) PIXEL AND ORGANIC LIGHT EMITTING DISPLAY DEVICE USING THE SAME

(75) Inventor: Jin-Tae Jeong, Yongin (KR)

(73) Assignee: Samsung Display Co., Ltd., Giheung-Gu, Yongin, Gyeonggi-Do (KR)

( * ) Notice: Subject to any disclaimer, the term of this patent is extended or adjusted under 35 U.S.C. 154(b) by 382 days.

(21) Appl. No.: 12/985,986

(22) Filed: Jan. 6, 2011

(65) Prior Publication Data

US 2012/0026145 A1 Feb. 2, 2012

(30) Foreign Application Priority Data

Aug. 2, 2010 (KR) ..... 10-2010-0074649

(51) Int. Cl.
*G09G 5/00* (2006.01)

(52) U.S. Cl.
USPC ..... 345/77; 345/82; 345/204

(58) Field of Classification Search
USPC ..... 345/77, 82, 204; 315/169.3
See application file for complete search history.

(56) References Cited

U.S. PATENT DOCUMENTS

| | | | | |
|---|---|---|---|---|
| 7,564,452 | B2 | 7/2009 | Komiya | |
| 7,579,781 | B2 * | 8/2009 | Lee et al. | 315/169.3 |
| 7,679,093 | B2 | 3/2010 | Park et al. | |
| 7,724,245 | B2 | 5/2010 | Miyazawa | |
| 7,737,927 | B2 * | 6/2010 | Kwon | 345/82 |
| 7,773,056 | B2 | 8/2010 | Kwak et al. | |
| 7,796,100 | B2 | 9/2010 | Kim | |
| 2008/0211796 | A1 | 9/2008 | Kim | |
| 2008/0218448 | A1 | 9/2008 | Park et al. | |
| 2008/0218450 | A1 | 9/2008 | Park | |
| 2008/0225022 | A1 | 9/2008 | Kim | |
| 2008/0246701 | A1 | 10/2008 | Park et al. | |
| 2009/0309816 | A1 | 12/2009 | Choi | |
| 2010/0007651 | A1 | 1/2010 | Kim | |
| 2010/0118020 | A1 | 5/2010 | Park et al. | |
| 2010/0220038 | A1 | 9/2010 | Chung et al. | |
| 2010/0220086 | A1 | 9/2010 | Chung et al. | |
| 2010/0245402 | A1 | 9/2010 | Choi et al. | |

FOREIGN PATENT DOCUMENTS

| | | |
|---|---|---|
| KR | 10-0628277 | 9/2006 |
| KR | 10-0903496 | 6/2009 |

* cited by examiner

*Primary Examiner* — Amare Mengistu
*Assistant Examiner* — Joseph G Rodriguez
(74) *Attorney, Agent, or Firm* — Robert E. Bushnell, Esq.

(57) ABSTRACT

A pixel of the present invention can display an image having uniform luminance. The pixel includes: an organic light emitting diode; a first transistor for controlling the amount of current flowing from a first power supply connected to a first electrode to the organic light emitting diode; a first capacitor having a first terminal connected to a data line; a third transistor positioned between a second node connected to a second terminal of the first capacitor and a first node connected to a gate electrode of the first transistor, and turned on when a first scan signal is supplied to the first scan line; and a fifth transistor connected between the second node and the data line, and turned off when an emission control signal is supplied to an emission control line.

16 Claims, 4 Drawing Sheets

PIXEL AND ORGANIC LIGHT EMITTING DISPLAY DEVICE USING THE SAME

CLAIM OF PRIORITY

This application makes reference to, incorporates the same herein, and claims all benefits accruing under 35 U.S.C. §119 from an application earlier filed in the Korean Intellectual Property Office on Aug. 2, 2010 and there duly assigned Serial No. 10-2010-0074649.

BACKGROUND OF THE INVENTION

1. Field of the Invention

The invention relates to an organic light emitting display device using a pixel, and more particularly a pixel that can display an image having uniform luminance, and an organic light emitting display device using the pixel.

2. Description of the Related Art

Recently, flat panel displays which make it possible to reduce the faults, the weight and the volume of cathode ray tube have been developed. Typical flat panel displays are a liquid crystal display, a field emission display, a plasma display panel, and an organic light emitting display device, etc.

The organic light emitting display device displays an image using an organic light emitting diode which produces light by recombining an electrode and a hole. The organic light emitting display device has an advantage in that it has high response speed and is driven by low power.

FIG. 1 is a circuit diagram illustrating a pixel of an organic light emitting display device.

Referring to FIG. 1, a pixel 4 of an organic light emitting display device includes: an organic light emitting diode OLED; and a pixel circuit 2 connected to a data line Dm and a scan line Sn for controlling the organic light emitting diode OLED.

The anode electrode of the organic light emitting diode OLED is connected to the pixel circuit 2 and the cathode electrode is connected to a second power supply ELVSS. The organic light emitting diode OLED produces light with predetermined luminance in response to the current supplied from the pixel circuit 2.

The pixel circuit 2 controls the amount of current supplied to the organic light emitting diode OLED in response to a data signal supplied to the data line Dm when a scan signal is supplied to the scan line Sn. For this configuration, the pixel circuit 2 includes: a second transistor M2 connected between a first power supply ELVDD and the organic light emitting diode OLED; a first transistor M1 connected between the second transistor M2, the data line Dm, and the scan line Sn; and a storage capacitor Cst connected between a gate electrode and a first electrode of the second transistor M2.

A gate electrode of the first transistor M1 is connected to the scan line Sn and a first electrode of the first transistor M1 is connected to the data line Dm. Furthermore, a second electrode of the first transistor M1 is connected to one terminal of the storage capacitor Cst. In this configuration, the first electrode of first transistor M1 is either a source electrode or a drain electrode, and the second electrode of the first transistor M1 is the other of a source electrode and a drain electrode. For example, when the first electrode is the source electrode, the second electrode is the drain electrode. The first transistor M1, connected to the scan line Sn and the data line Dm, is turned on and supplies a data signal, which is supplied through the data line Dm, to the storage capacitor Cst. In this operation, the storage capacitor Cst is charged with a voltage corresponding to the data signal.

The gate electrode of the second transistor M2 is connected to one terminal of the storage capacitor Cst, and the first electrode of the second transistor M2 is connected to the first power supply ELVDD and to the other terminal of the storage capacitor Cst. Furthermore, the second electrode of the second transistor M2 is connected to the anode of the organic light emitting diode OLED. The second transistor M2 controls the amount of current flowing from the first power supply ELVDD to the second power supply ELVSS through the organic light emitting diode OLED in response to the voltage value stored in the storage capacitor Cst. In the configuration, the organic light emitting diode OLED emits light corresponding to the amount of current supplied from the second transistor M2.

However, the pixel 4 of the organic light emitting display device cannot display an image with uniform luminance. To be more specific, the second transistor M2 (driving transistor) in such pixels 4 has a different threshold voltage for each pixel 4 due to process variation. As the threshold voltages of the driving transistors are different, light with different luminance is generated by the difference in the threshold voltage of the driving transistors, even if data signals corresponding to the same gradation are supplied to the pixels 4.

SUMMARY OF THE INVENTION

The present invention provides an organic light emitting display device which can display an image having uniform luminance, and an organic light emitting display device using the pixel.

According to an aspect of the present invention, there is provided a pixel which includes: an organic light emitting diode; a first transistor for controlling the amount of current flowing from a first power supply, connected to a first electrode, to the organic light emitting diode; a first capacitor having a first terminal connected to a data line; a third transistor positioned between a second node connected to a second terminal of the first capacitor and a first node connected to a gate electrode of the first transistor, and turned on when a first scan signal is supplied to the first scan line; and a fifth transistor connected between the second node and the data line and turned off when an emission control signal is supplied to an emission control line.

The pixel further includes: a second transistor connected between the second node and the second electrode of the first transistor and turned on when a second scan signal is supplied to a second scan line; a fourth transistor connected between the second electrode of the first transistor and the organic light emitting diode, and turned off when the emission control signal is supplied to the emission control line; and a second capacitor connected between the first node and the first power supply. The third transistor and the second transistor are simultaneously turned on. The third transistor is turned on for a longer time than the second transistor. The fourth transistor and the fifth transistor are turned off when the third transistor is turned on, and are turned on when the third transistor is turned off. The first capacitor has a capacitance larger than that of the second capacitor.

According to another aspect of the present invention, there is provided an organic light emitting display device including: a scan driver for driving first scan lines, second scan lines and emission control lines; a data driver for driving data lines; switching units positioned between the data lines and the data driver for connecting the data lines to any one of a reference power supply and the data driver; and pixels positioned at the intersections of the first scan lines and the data lines. In this arrangement, the pixels in the i-th is a natural number) horizontal line each include: an organic light emitting diode; a first transistor for controlling the amount of current flowing from a first power supply, connected to a first electrode, to the organic light emitting diode; a first capacitor having a first terminal connected to the j-th (j is a natural number) data line; a third transistor positioned between a second node connected to a second terminal of the first capacitor and a first node connected to a gate electrode of the first transistor, and turned on when a first scan signal is supplied to the i-th first scan line; and a fifth transistor connected between the second node and the data lines, and turned off when an emission control signal is supplied to the i-th emission control line.

The pixels each further include: a second transistor connected between the second node and the second electrode of the first transistor, and turned on when a second scan signal is supplied to an i-th second scan line; a fourth transistor connected between the second electrode of the first transistor and the organic light emitting diode, and turned off when the emission control signal is supplied to the i-th emission control line; and a second capacitor connected between the first node and the first power supply.

The scan driving unit supplies a second scan signal to the i-th second scan line simultaneously with a first scan signal supplied to the i-th first scan line. The first control signal is set to have a width larger than the second scan signal. The scan driving unit supplies the emission control signal to the i-th emission control line so as to overlap the first scan signal supplied to the i-th first scan line. The switching unit in the j-th data line includes: a first switching device connected between the reference power supply and the j-th data line, and turned on while the second scan signal is supplied; and a second switching device connected between the data driver and the j-th data line, and turned on during another time except for the time when the first switching device is turned on, in the period where the first scan signal is supplied.

With the present invention, it is possible to display an image having uniform luminance by compensating threshold voltage of a driving transistor using a pixel and an organic light emitting display device according to an embodiment of the present invention. Furthermore, voltage for charging a second capacitor is determined regardless of voltage drop of a first power supply ELVDD, and accordingly, it is possible to display an image having desired luminance regardless of the voltage drop of the first power supply ELVDD.

BRIEF DESCRIPTION OF THE DRAWINGS

The accompanying drawings, together with the specification, illustrate exemplary embodiments of the present invention, and, together with the description, serve to explain the principles of the present invention.

DETAILED DESCRIPTION OF THE INVENTION

Figure 1:
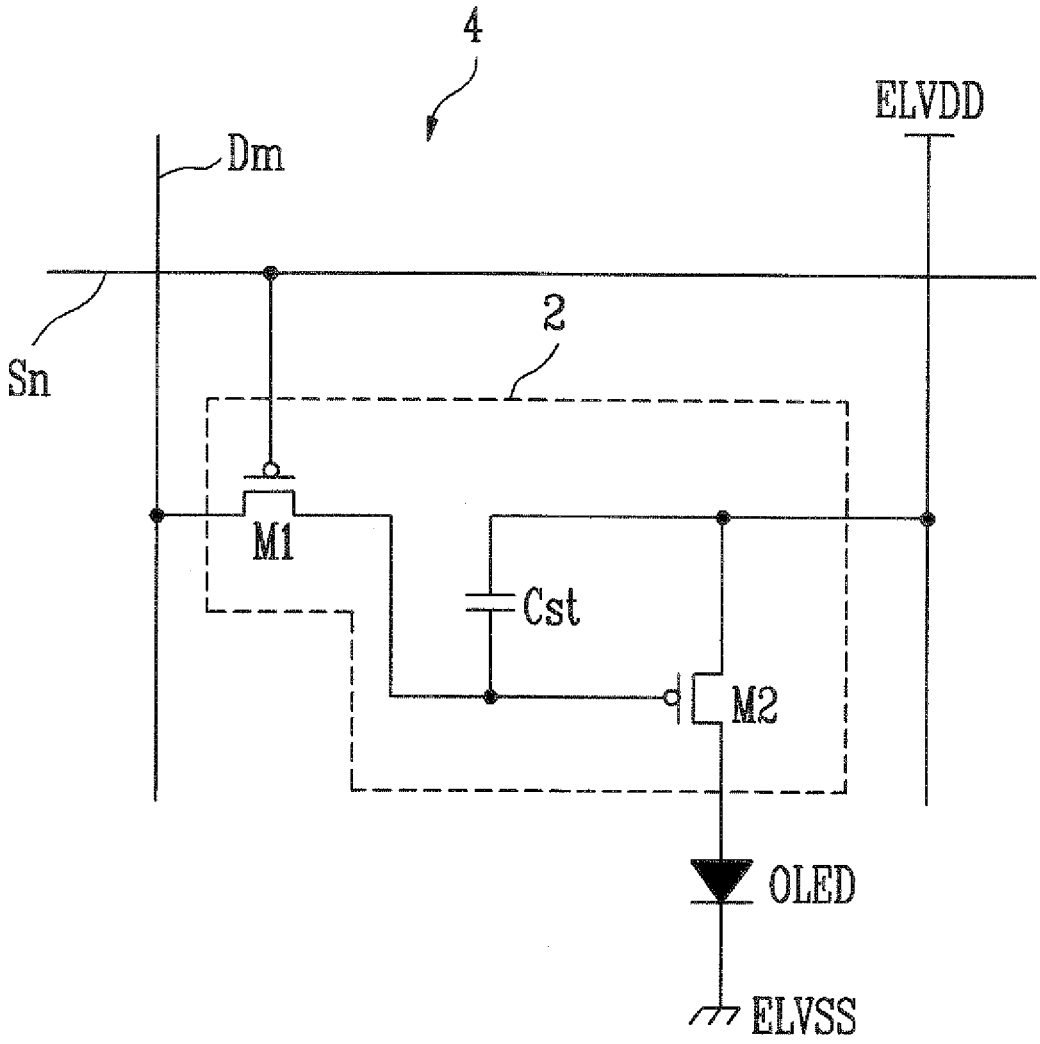
FIG. 1 is a circuit diagram illustrating a pixel of an organic light emitting display.

Hereinafter, certain exemplary embodiments according to the present invention will be described with reference to the accompanying drawings. When a first element is described as being coupled to a second element, the first element may be not only directly coupled to the second element but may also be indirectly coupled to the second element via a third element. Furthermore, some of the elements which are not essential to a complete understanding of the invention are omitted for clarity. Also, like reference numerals refer to like elements throughout.

Preferred embodiments for those skilled in the art to easily implement the present invention are described hereafter in detail with reference to FIGS. 2 to 5.

Figure 2:
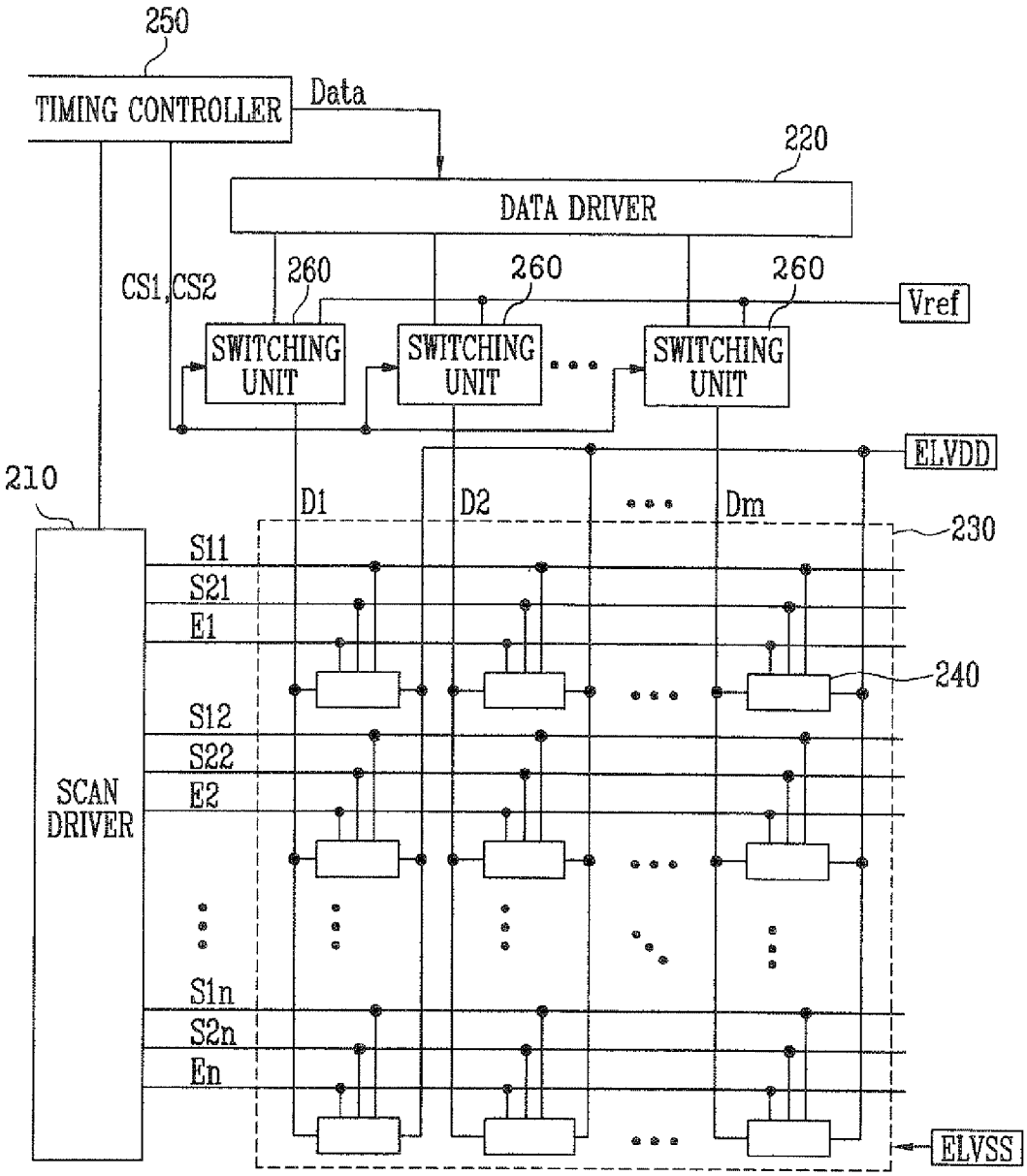
FIG. 2 is a diagram illustrating an organic light emitting display device according to an embodiment of the present invention.

FIG. 2 is a diagram illustrating an organic light emitting display device according to an embodiment of the present invention.

Referring to FIG. 2, an organic light emitting display device according to an embodiment of the present invention includes first scan lines S11 to S1*n*, second scan lines S21 to S2*n*, a pixel unit 230 including pixels 240 connected with emission control lines E1 to En and data lines D1 to Dm, a scan driver 210 driving the first scan lines S11 to S1*n*, the second scan lines S21 to S2*n*, and the emission control lines E1 to En, a data driver 220 driving the data lines D1 to Dm, switching units 260 connected to the data lines D1 to Dm, and a timing controller 250 for controlling the scan driver 210 and the data driver 220.

The scan driver 210 sequentially supplies first scan signals to the first scan signal lines S11 to S1*n* and sequentially supplies second scan signals to the second scan lines S21 to S2*n*. The first scan signal supplied to the i-th (i is a natural number) first scan line S1*i* is supplied, simultaneously with the second scan signal supplied to the i-th second scan line S2*i*, for a predetermine time longer than the second scan signal (i.e. with a large width) herein.

Furthermore, the scan driver 210 sequentially supplies emission control signals to the emission control lines E1 to En. The emission control signal supplied to the i-th emission control line Ei is supplied so as to overlap the first scan signal supplied to the first scan line Si herein.

The data driving unit 220 supplies data signals to the data lines D1 to Dm.

The timing controller 250 controls the scan driving unit 210 and the data driving unit 220 in response to synchronization signals supplied from the outside. Furthermore, the timing controller 250 supplies first control signal CS1 and second control signal CS2 to the switching units 260. The first control signal CS1 is supplied so as to overlap the second scan signal supplied to the second scan signals S21 to S2*n*, and the second control signal CS2 is supplied so as to overlap the first scan signal supplied to the first scan lines S11 to S1*n* herein. The supply times of the first scan signal CS1 and the second scan signal CS2 do not overlap each other.

The switching units 260 are positioned between the data driver 220 and the data lines D1 to Dm, respectively. The switching units 260 connect the data lines D1 to Dm with the data driver 220 or a reference power supply Vref in response to the first control signal CS1 and the second control signal CS2 which are supplied from the timing controller 250.

For example, the switching units 260 connect the data lines D1 to Dm with the reference power supply Vref when the first control signal CS1 is supplied, and connect the data lines D1 to Dm with the data driver 220 when the second control signal CS2 is supplied. The reference power supply Vref is set at a voltage between a black gradation data signal and a white gradation data signal. This will be described in detail below.

The pixel unit 230 supplies power, which is supplied from the first power supply ELVDD and the second power supply ELVSS at the outside, to the pixels 240. The pixels 240 receive the first power ELVDD and the second power ELVSS and generate light having predetermined luminance while controlling the amount of current flowing from the first power supply ELVDD to the second power supply ELVSS through the organic light emitting diode.

Figure 3:
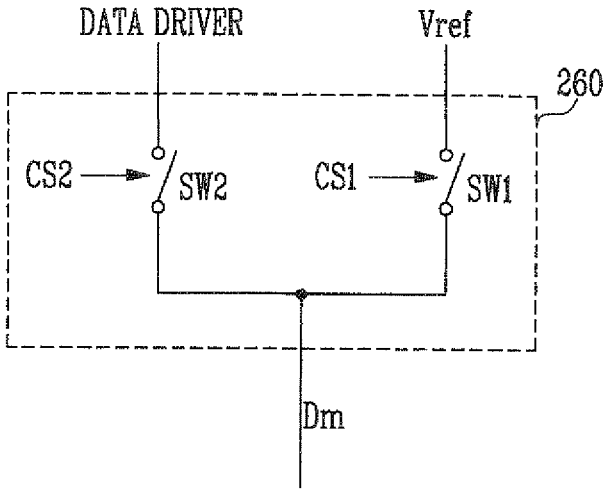
FIG. 3 is a diagram illustrating an embodiment of a switching unit shown in FIG. 2.

FIG. 3 is a diagram illustrating an embodiment of the switching unit shown in FIG. 2. The switching unit 260 connected to the m-th data line Dm is shown in FIG. 3, for the convenience of description.

Referring to FIG. 3, the switching unit 260 according to an embodiment of the present invention includes a first switching device SW1 connected between the data line Dm and the reference power supply Vref and a second switching device SW2 connected between the data line Dm and the data driver 220.

The first switching device SW1 is turned on and connects the data line Dm to the reference power supply Vref, when the first control signal CS1 is supplied.

The second switching device SW2 is turned on and connects the data driver 220 to the data line Dm when the second control signal CS2 is supplied. In this configuration, the data line Dm is supplied with a data signal from the data driver 220.

Figure 4:
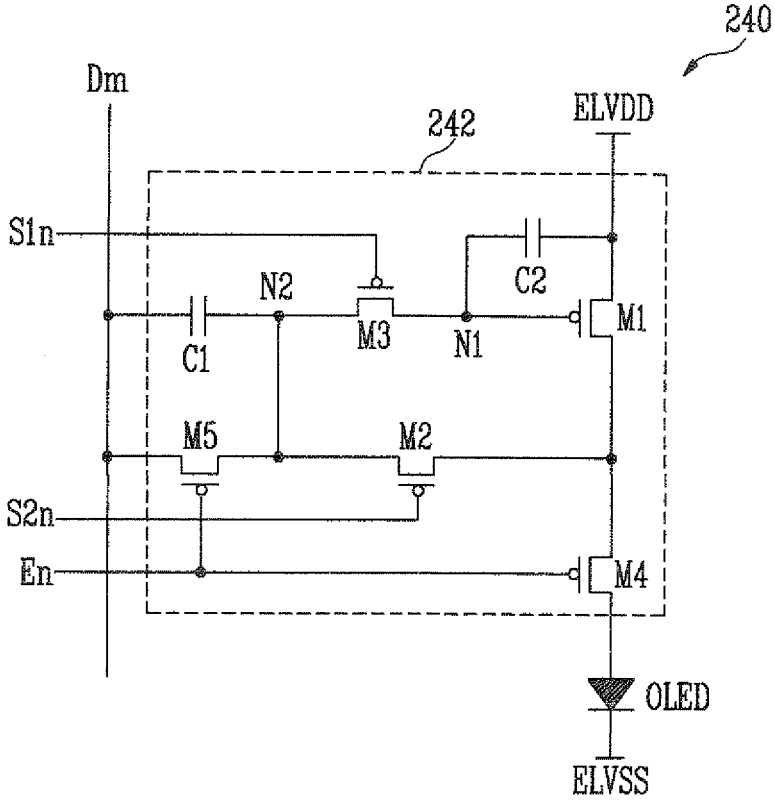
FIG. 4 is a diagram illustrating an embodiment of a pixel shown in FIG. 2.

FIG. 4 is a diagram illustrating an embodiment of a pixel shown in FIG. 2. The pixel connected to the n-th first scan line S1*n* and the m-th data line Dm is shown in FIG. 4 for the convenience of description.

Referring to FIG. 4, the pixel 240 according to an embodiment of the present invention includes: an organic light emitting diode OLED; and a pixel circuit 242 connected to the first scan line S1*n*, the second scan line S2*n*, the emission control line En, and the data line Dm, and controls the amount of current supplied to the organic light emitting diode OLED.

The anode electrode of the organic light emitting diode OLED is connected to the pixel circuit 242 and the cathode electrode thereof is connected to the second power supply ELVSS. The organic light emitting diode OLED produces light with predetermined luminance in response to the current supplied from the pixel circuit 242.

The pixel circuit 242 controls the amount of current supplied to the second power source ELVSS through organic light emitting diodes OLED from a first power source ELVDD in response to the data signal. For this operation, the pixel circuit 242 includes first to fifth transistors M1 to M5, a first capacitor C1, and a second capacitor C2.

A first electrode of the first transistor M1 is connected to the first power supply ELVDD and a second electrode thereof is connected to the first electrode of the fourth transistor M4. Furthermore, a gate electrode of the first transistor M1 is connected o a first node N1. The first transistor M1 controls the amount of current supplied to the organic light emitting diode OLED in response to the voltage applied to the first node N1.

A first electrode of the second transistor M2 is connected to the second electrode of the first transistor M1 and a second electrode of the second transistor M2 is connected to second node N2. Furthermore, a gate electrode of the second transistor M2 is connected to the second scan line S2*n*. The second transistor M2 is turned on and electrically connects the second node N2 with the second electrode of the first transistor M1 when a second scan signal is supplied to the second scan line S2*n*.

A first electrode of the third transistor M3 is connected to the second node N2 and the second electrode thereof is connected to the first node N1. Furthermore, a gate electrode of the third transistor M3 is connected to the first scan line S1*n*. The third transistor M3 is turned on and electrically connects the first node N1 and the second node N2 when the first scan signal is supplied to the first scan line S1*n*.

A first electrode of the fourth transistor M4 is connected to the second electrode of the first transistor M1 and a second electrode of the fourth transistor M4 is connected to the anode of the organic light emitting diode OLED. Furthermore, the gate electrode of the fourth transistor M4 is connected to the emission control line En. The fourth transistor M4 having the above configuration is turned on and electrically connects the organic light emitting diode to the second electrode of the first transistor M1 when an emission control signal is not supplied to the emission control line En.

A first electrode of the fifth transistor M5 is connected to the data line Dm and a second electrode thereof is connected to the second node N2. Furthermore, the gate electrode of the fifth transistor M5 is connected to an emission control line En. The fifth transistor M5 is turned on and electrically connects the data line Dm to the second node N2 when the emission signal is not supplied to the emission control line En.

The second capacitor C2 is connected between the first node N1 and the first power supply ELVDD. In this operation, the second capacitor C2 is charged to a voltage corresponding to a data signal and threshold voltage of the first transistor M1.

The first capacitor C1 is connected between the data line Dm and the second node N2. The first capacitor C1 controls the voltage at the second node N2 in accordance with changes in voltage of the data line Dm. Furthermore, the first capacitor C1 is charged to a predetermined voltage (e.g. voltage of the data signal) while the organic light emitting diode OLED emits light, and initializes the first node N1 using the voltage. For this configuration, the first capacitor C1 has a capacity larger than that of the second capacitor C2.

Figure 5:
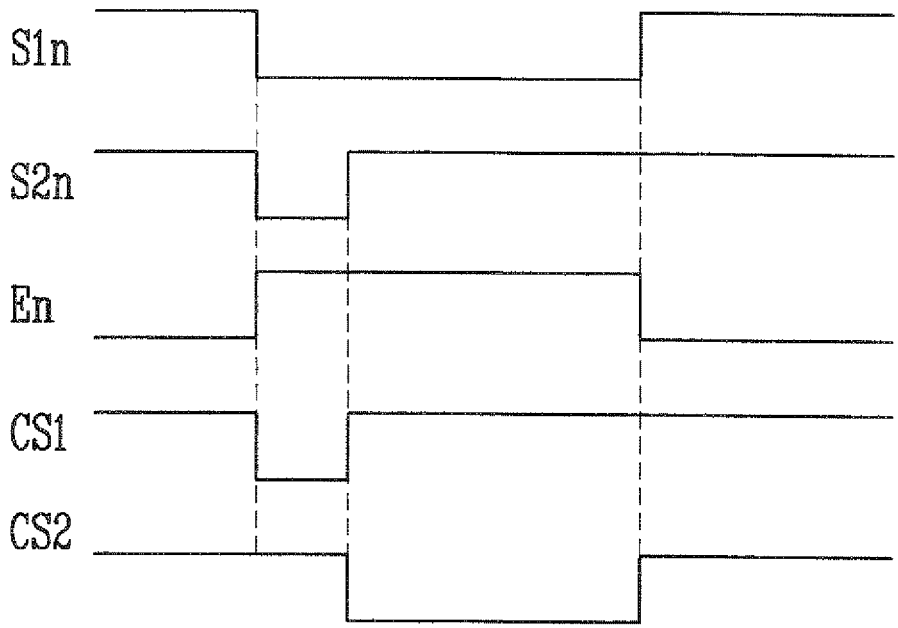
FIG. 5 is a waveform diagram illustrating a method of driving the pixel shown in FIG. 4.

FIG. 5 is a waveform diagram illustrating a method of driving the pixel shown in FIG. 4.

Referring to FIG. 5, a scan signal is supplied to the first scan line S1*n*, and a second scan signal is supplied to the second scan line S2*n*. Furthermore, an emission control signal is supplied to the emission control line En, and the first control signal CS1 is supplied to the switching unit 260.

The first switching device SW1 is turned on when the first control signal CS1 is supplied to the switching unit 260. As the first switching device SW1 is turned on, the voltage of the reference power supply is supplied to the data line Dm.

As the emission control signal is supplied to the emission control line En, the fourth transistor M4 and the fifth transistor M5 are turned off. The first transistor M1 and the organic light emitting diode OLED are electrically connected when the fourth transistor M4 is turned off. Therefore, the organic light emitting diode OLED does not emit light. The data line Dm and the second node N2 are electrically isolated when the fifth transistor M5 is turned off.

As the first scan signal is supplied to the first scan signal S1*n*, the third transistor M3 is turned on. As the third transistor M3 is turned on, the first node N1 and the second node N2 are electrically connected. In this case, the voltage of the first node N1 is reduced by the voltage (e.g. voltage of the data signal) that has been applied to the second node N2. This will be described in detail below.

As the second scan signal is supplied to the second scan line S2*n*, the second transistor M2 is turned on. The second node N2 and the second electrode of the first transistor M1 are electrically connected when the second transistor M2 is turned on.

The first transistor M1 is connected in a diode type configuration, when the second transistor M2 and the third transistor M3 are turned on. As the first transistor M1 is connected in the diode type configuration a voltage obtained by subtracting the threshold voltage of the first transistor m1 from the first power ELVDD is supplied to the first node N1. The second capacitor C2 is charged to a voltage corresponding to the threshold voltage of the first transistor M1.

The voltage of the charged second capacity C2 corresponds to the threshold voltage of the first transistor M1 regardless of the first power ELVDD. In other words, in the present invention, the second capacitor C2 is charged regardless of a voltage drop of the first power supply ELVDD, and accordingly, it is possible to display an image having the desired luminance.

After the second capacitor C2 is charged with a voltage corresponding to the threshold voltage of the first transistor M1, supply of a second scan signal and the first control signal CS1 is stopped while the second control signal CS2 is supplied to the switching unit 260.

The second switching device SW2 is turned on when the second control signal CS2 is supplied. As the second switching device SW2 is turned on, the data line Dm and the data driver 220 are electrically connected. The data driver supplies a data signal to the data line Dm. The voltage of the data line Dm is changed from the voltage of the reference power supply Vref to the voltage of the data line.

For example, when voltages of a black data signal, a white data signal, and the reference power supply Vref are 5V, 1V, and 4.5V, respectively, the data signal supplied to the data line Dm is set to a voltage between 5V and 1V in accordance with gradation. For example, when the black data signal is supplied, the voltage of the data line Dm increases from the voltage of the reference power supply Vref to the voltage of the black data signal. The voltages at the first node N1 and the second node N2 are also increased by the first capacitor C1. Therefore, the first transistor M1 is turned off, and accordingly black gradation can be implemented.

Furthermore, when the white data signal is supplied, the voltage of the data line Dm decreases from the voltage of the reference power supply Vref to the voltage of the white data signal. The voltages at the first node N1 and the second node N2 are also decreased by the first capacitor C1. The first transistor M1 supplies current corresponding to the white data signal to the organic light emitting diode OLED in response to the voltage applied to the first node N1. That is, in the present invention, the voltage at the first node N1 is controlled by a voltage difference between the data signal and the reference power supply Vref, and accordingly it is possible to display an image corresponding to the gradation.

Supply of the first scan signal and the emission control signal is stopped after voltage corresponding to the data signal is applied to the first node N1. As supply of the first scan signal to the first scan signal S1*n* is stopped, the third transistor M3 is turned off. As the third transistor M3 is turned off, the first node N1 and the second node N2 are electrically isolated. As described above, as the first node N1 and the second node N2 are electrically isolated, the voltage at the first node N1 is stably maintained, regardless of voltage changes of the data line Dm.

As supply of the emission control signal to the emission control line En is stopped, the fourth transistor M4 and the fifth transistor M5 are turned on. As the fourth transistor M4 is turned on, the second electrode of the first transistor M1 and the anode electrode of the organic light emitting diode OLED are electrically connected. The first transistor M1 controls the amount of current supplied to the organic light emitting diode OLED in response to the voltage applied to the first node N1.

The data line Dm and the second node N2 are electrically connected when the fifth transistor M5 is turned on. As the data line Dm and the second node N2 are connected, load in the data line can be minimized.

In detail, the capacitors C1 in the pixels are connected to the data line Dm. As described above, since the capacitors C1 are connected to the data line Dm, the load in the data line Dm increases. Therefore, it is possible to prevent the first capacitors C1 from functioning as a load by turning on the fifth transistors M5 in the other pixels, except for the pixels where the data signals are supplied.

Furthermore, when the fifth transistor M5 is turned on, the voltage of the second node N2 is set to the voltage of the data signal having predetermined gradation, and the voltage is maintained by the first capacitor C1. Furthermore, since the first capacitor C1 has a capacitance larger than that of the second capacitor C2, the voltage of the first node N1 decreases with respect to the voltage of the second node N2 when the third transistor M3 is turned on. As described above, as the voltage of the first node N1 decreases, the first transistor M1 can be stably turned on when being connected in a diode type configuration.

While the present invention has been described in connection with certain exemplary embodiments, it is to be understood that the invention is not limited to the disclosed embodiments, but, on the contrary, is intended to cover various modifications and equivalent arrangements included within the spirit and scope of the appended claims, and equivalents thereof.

What is claimed is:

1. A pixel, comprising:

an organic light emitting diode;

a first transistor having a first electrode connected to a first power supply, a second electrode connected to the organic light emitting diode, and a gate electrode connected to a first node, said first transistor controlling an amount of current flowing from the first power supply via the first electrode and the second electrode to the organic light emitting diode;

a first capacitor having a first terminal connected to a data line and a second terminal connected to a second node;

a third transistor having a first electrode connected to the second node, a second electrode connected to the first node, and a gate electrode connected to a first scan line, said third transistor being turned on when a first scan signal is supplied to the first scan line; and a fifth transistor connected between the second node and the data line, and having a gate electrode connected to an emission control line, said fifth transistor being turned off when an emission control signal is supplied to the emission control line so as to electrically disconnect the data line from the second node when the emission control signal is supplied to the emission control line.

2. The pixel as claimed in claim 1, further comprising:

a second transistor connected between the second node and the second electrode of the first transistor, and turned on when a second scan signal is supplied to a second scan line;

a fourth transistor connected between the second electrode of the first transistor and the organic light emitting diode, and turned off when the emission control signal is supplied to the emission control line; and a second capacitor connected between the first node and the first power supply.

3. The pixel as claimed in claim 2, wherein the second transistor and the third transistor are simultaneously turned on.

4. The pixel as claimed in claim 3, wherein the third transistor is turned on for a longer time than the second transistor.

5. The pixel as claimed in claim 2, wherein the fourth transistor and the fifth transistor are turned off when the third transistor is turned on, and are turned on when the third transistor is turned off.

6. The pixel as claimed in claim 2, wherein the first capacitor has a capacitance larger than a capacitance of the second capacitor.

7. An organic light emitting display device, comprising a scan driver for driving first scan lines, second scan lines, and emission control lines;

a data driver for driving data lines;

switching units positioned between the data lines and the data driver, and connecting the data lines to one of a reference power supply and the data driver; and pixels positioned at the intersections of the first scan lines and the data lines;

wherein pixels in an i-th (i is a natural number) horizontal line each include:

an organic light emitting diode;

a first transistor having a first electrode connected to a first power supply, a second electrode connected to the organic light emitting diode, and a gate electrode connected to a first node, said first transistor controlling an amount of current flowing from the first power supply via the first electrode and the second electrode to the organic light emitting diode;

a first capacitor having a first terminal connected to a j-th (j is a natural number) data line and a second terminal connected to a second node;

a third transistor having a first electrode connected to the second node, a second electrode connected to the first node, and a gate electrode connected to a first scan line, said third transistor being turned on when a first scan signal is supplied to an i-th scan line; and a fifth transistor connected between the second node and the data lines, and having a gate electrode connected to an i-th emission control line, said fifth transistor being turned off when an emission control signal is supplied to the i-th emission control line so as to electrically disconnect the data line from the second node when the emission control signal is supplied to the i-th emission control line.

8. The organic light emitting display device as claimed in claim 7, wherein each of the pixels further includes:

a second transistor connected between the second node and the second electrode of the first transistor, and turned on when a second scan signal is supplied to an i-th second scan line;

a fourth transistor connected between the second electrode of the first transistor and the organic light emitting diode, and turned off when the emission control signal is supplied to the i-th emission control line; and a second capacitor connected between the first node and the first power supply.

9. The organic light emitting display device as claimed in claim 8, wherein the scan driver supplies the second scan signal to the i-th second scan line simultaneously with the first scan signal being supplied to the i-th first scan line.

10. The organic light emitting display device as claimed in claim 9, wherein a first control signal is set to have a width larger than a width of the second scan signal.

11. The organic light emitting display device as claimed in claim 8, wherein the scan driver supplies the emission control signal to the i-th emission control line so as to overlap the first scan signal supplied to the i-th first scan line.

12. The organic light emitting display device as claimed in claim 8, further comprising a switching unit in the j-th data line, said switching unit including:

a first switching device connected between the reference power supply and the j-th data line, and turned on while the second scan signal is supplied; and a second switching device connected between the data driver and the j-th data line, and turned on during another time, except for the time when the first switching device is turned on, in a period where the first scan signal is supplied.

13. The organic light emitting display device as claimed in claim 7, wherein the reference power supply has a voltage between a black gradation data signal and a white gradation data signal.

14. The organic light emitting display device as claimed in claim 8, wherein the first capacitor has a capacitance larger than a capacitance of the second capacitor.

15. The organic light emitting display device as claimed in claim 1, wherein the fifth transistor is turned on and electrically connects the data line to the second node when the emission control signal is not supplied to the emission control line.

16. The organic light emitting display device as claimed in claim 7, wherein the fifth transistor is turned on and electrically connects the data line to the second node when the emission control signal is not supplied to the i-th emission control line.

* * * * *